US006516524B1

(12) United States Patent
Brady

(10) Patent No.: US 6,516,524 B1
(45) Date of Patent: Feb. 11, 2003

(54) BATTERY OPERATED PORTABLE CAN OPENER

(75) Inventor: Martin Brady, Chesterfield, VA (US)

(73) Assignee: Hamilton Beach/Proctor-Silex, Inc., Glen Allen, VA (US)

( * ) Notice: Subject to any disclaimer, the term of this patent is extended or adjusted under 35 U.S.C. 154(b) by 0 days.

(21) Appl. No.: 09/694,204

(22) Filed: Oct. 23, 2000

(51) Int. Cl.[7] ..... B67B 7/46
(52) U.S. Cl. ..... 30/404; 30/421; 30/423
(58) Field of Search ..... 30/403, 404, 405, 30/416, 421, 422, 423, 424, 425; D8/36

(56) References Cited

U.S. PATENT DOCUMENTS

| | | | | | |
|---|---|---|---|---|---|
| 3,623,523 | A | | 11/1971 | Meyer et al. | |
| 3,635,270 | A | | 1/1972 | Petroske et al. | |
| 3,675,321 | A | | 7/1972 | Arel et al. | |
| 3,791,029 | A | * | 2/1974 | Yamamoto | 30/404 |
| 4,053,981 | A | | 10/1977 | Aberer | |
| 4,534,108 | A | | 8/1985 | Yamamoto et al. | |
| 4,561,182 | A | | 12/1985 | Yamamoto et al. | |
| 4,622,749 | A | | 11/1986 | Inagaki | |
| 4,702,007 | A | | 10/1987 | Nomura et al. | |
| 4,734,985 | A | | 4/1988 | Ozaki | |
| 4,860,455 | A | * | 8/1989 | Conneally | 30/404 |
| 4,901,441 | A | | 2/1990 | Kurz | |
| 4,995,164 | A | | 2/1991 | Borger et al. | |
| D319,956 | S | * | 9/1991 | Barrault | D8/36 |
| 5,239,757 | A | | 8/1993 | Weaber | |
| 5,664,333 | A | | 9/1997 | Hardman | |
| D417,129 | S | | 11/1999 | Brady et al. | |
| D418,029 | S | * | 12/1999 | Leverrier | D8/36 |
| D418,728 | S | | 1/2000 | Kalina et al. | |
| D421,205 | S | * | 2/2000 | Naft et al. | D8/36 |
| D422,468 | S | | 4/2000 | Cruz | |
| D423,311 | S | * | 4/2000 | Fitzpatrick | D8/36 |
| 6,092,292 | A | | 7/2000 | Molnar et al. | |
| D444,686 | S | * | 7/2001 | Brady | D8/36 |
| D452,421 | S | * | 12/2001 | DeMore et al. | D8/36 |

OTHER PUBLICATIONS

Hamilton Beach/Proctor–Silex, Inc., "Under–Cabinet Opening Center with Shears"www.hamiltonbeach.com, Oct. 18, 2000.

Hamilton Beach/Proctor–Silex, Inc., "OpenEase™ Extra Tall Can Opener"www.hamiltonbeach.com, Oct. 18, 2000.

Hamilton Beach/Proctor–Silex, Inc., "Hamilton Can Openers" Model No.: 76600 SmoothEdge™ Extra Tall; 76350 Penguin® Extra Tall; 76329 OpenEase™ Extra Tall; 76300R OpenEase™ Extra Tall and 76450 Under–Cabinet Opening Center, www.hamiltonbeach.com, Jan. 08, 2001.

Two page "Presto On–Line Catalog", Hide'nSleek™ Electric Can Opener, http://www.gopresto.com/productinfo/catalog/canopeners.html, Oct. 18, 2000.

* cited by examiner

*Primary Examiner*—Hwei-Siu Payer
(74) *Attorney, Agent, or Firm*—Akin Gump Strauss Hauer & Feld, L.L.P.

(57) ABSTRACT

A can opener for severing a lid from a can. The can opener includes a housing having a shape generally in the form of a semi-sphere. The housing has a semispherical shell and an opposing working face. A cutting mechanism is positioned on the working face for movement along a circumference of the lid to sever the lid from the can. A drive mechanism is mounted to the housing for moving the can opener relative to the can.

23 Claims, 5 Drawing Sheets

BATTERY OPERATED PORTABLE CAN OPENER

BACKGROUND OF THE INVENTION

The present invention relates to an electric can opener for severing a lid from a can and, more specifically, to a battery operated portable electric can opener which can be supported on a can for severing the lid.

Portable can openers generally consist of a housing which is fitted with a cutter for piercing and severing the lid from a can, a driving wheel for rotating the can relative to the cutter, and a mechanism for rotating the driving wheel. Most such portable can openers include batteries within the body for powering an electric motor, both of which reside within the housing. Further, prior art portable can openers that are intended to be supported on the rim of a can generally include an elongated handle to accommodate the hand of the user when the user positions the can opener on the can and when the user holds the can opener while the cutter severs the lid. Those portable prior art can openers that do not have elongated handles are generally of the type that have elongated, upright rectangular housings which are intended to rest on a countertop or other flat, horizontal surface. As such, these types of can openers support the can while the lid is being severed.

The significant drawback of both types of prior art can openers is that on all but the largest cans the can openers cannot travel around the upper periphery of the can without tipping the can onto its side due to the eccentric loading caused by the elongated handle or the size and weight of the housing. Further, prior art can openers do not provide a comfortable gripping shape which is naturally accommodating to the hand of the user.

The present invention overcomes these shortcomings by providing a can opener that is ergonomically designed to be naturally and securely gripped by the user's hand. Further, the present invention provides a can opener that can be fully supported by small and medium sized cans without tipping the cans onto their sides. These and further advantages will be fully discussed in the detailed description below.

BRIEF SUMMARY OF THE INVENTION

Briefly stated, the present invention is directed to a can opener for severing a lid from a can. The can opener includes a housing having a shape generally in the form of a semisphere. The housing has a semispherical shell and an opposing working face. A cutting mechanism is positioned on the working face for movement along a circumference of the lid to sever the lid from the can such that the can supports the entire weight of the can opener while severing. A drive mechanism is mounted to the housing for moving the can opener relative to the can.

In an alternative embodiment, the can opener includes a housing without an extended handle. The can opener further includes a cutting mechanism for movement along a circumference of the lid and thereby severing the lid from the can, and a drive mechanism for moving the can opener relative to the can wherein the housing, cutting mechanism and drive mechanism are sized and positioned such that the can opener is fully supported by the can during severing.

In another alternative embodiment of the can opener, the can has a longitudinal axis therethrough passing through the center of gravity of the can. The longitudinal axis of the can is oriented vertically during severing. A vertical axis passes through the center of gravity of the can opener when the can opener is positioned on the can for severing the lid. The can opener includes a cutting mechanism for movement along a circumference of the lid and thereby severing the lid from the can, and a drive mechanism for moving the can opener relative to the can. The can opener is fully supported on the can during severing and configured such that an angle of less than about twenty degrees exists between: (a) a first horizontal line passing through the longitudinal axis of the can and extending through a point of contact between the cutting mechanism and the lid, and (b) a second horizontal line, coplanar with the first horizontal line, passing through the longitudinal axis of the can and extending through the vertical axis passing through the center of gravity of the can opener.

BRIEF DESCRIPTION OF THE SEVERAL VIEWS OF THE DRAWINGS

The foregoing summary, as well as the following detailed description of the preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
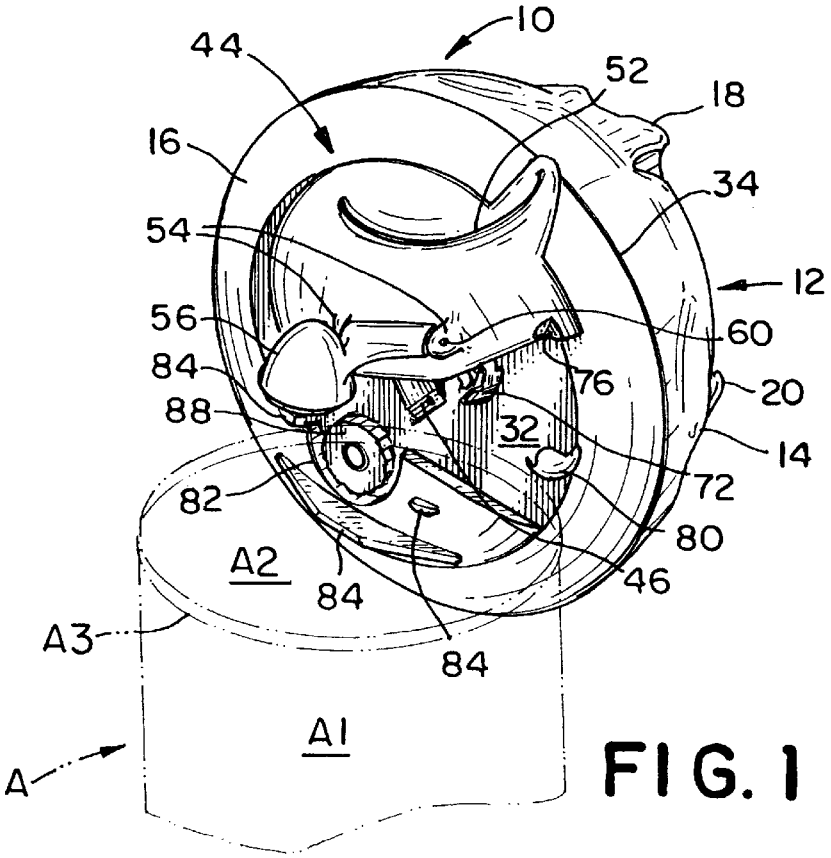
FIG. 1 is a front perspective view of a can opener in accordance with a preferred embodiment of the present invention, showing a can in phantom.
Figure 2:
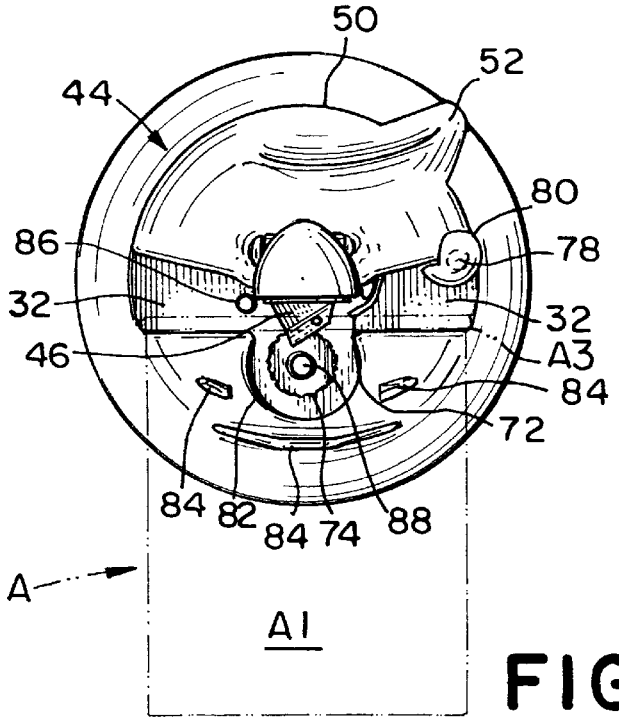
FIG. 2 is a front elevational view of the can opener of FIG. 1.

Referring now to FIGS. 1 and 2, the present invention relates to a battery operated portable can opener, generally designated 10, which is adapted to be installed or applied on a can A to sever a lid A2 from the can A. As is well known, a can A includes a cylindrical sidewall A1, and the lid A2 which is attached to the sidewall A1 by a rolled or pressed seam A3. The portable can opener 10 is configured, as described in detail below, to sever the lid A2 from the can A.

Figure 3:
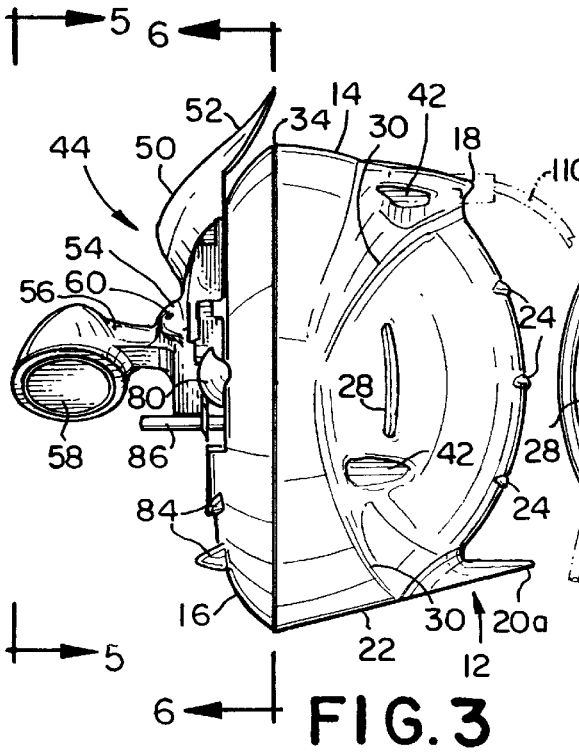
FIG. 3 is a side elevational view of the can opener of FIG. 1.

With reference to FIGS. 1 and 3, in the preferred embodiment, the can opener 10 includes a housing 12 which serves two primary purposes. First, the housing 12 provides a gripping surface such that the opener 10 may be securely gripped by the hand of the user. Second, the housing 12 encloses the mechanical components that drive the can opener 10, as will be discussed below. The housing 12 of the preferred embodiment is optimized regarding both primary functions through the use of a shape which is generally in the form of a semi-sphere and sized to fit comfortably within the hand of a user. It is contemplated that other shape housings such as rectangular, round, etc. may be used without departing from the spirit and scope of the invention.

Figure 4:
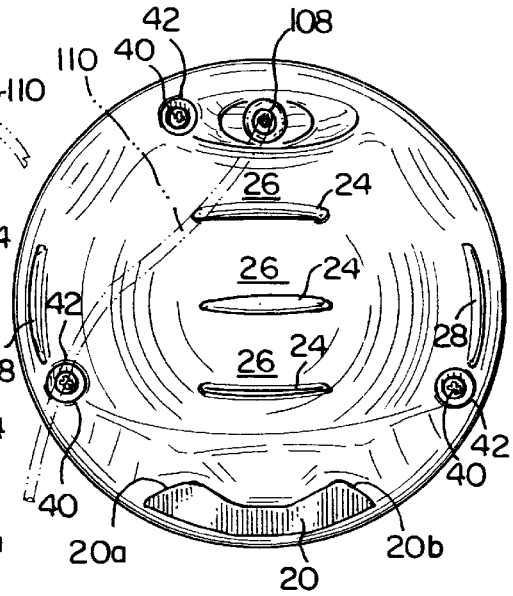
FIG. 4 is a rear elevational view of the can opener of FIG. 1.

Referring to FIGS. 1, 3 and 4, the housing 12 includes a shell 14 which is generally semispherical and is hollow to receive in its interior the various mechanical and electrical components to be described below. The external surface of the shell 14 includes various features that enhance the ergonomic effectiveness of the housing 12. To facilitate secure engagement between the hand of the user and the housing 12, the shell 14 is provided with an upper protuberance 18 which extends outwardly from the shell 14 and has gently radiused surfaces to enhance comfort. As viewed in FIG. 3, the upper protuberance 18 is positioned near the top of the shell 14 to engage the lateral outer surface of the user's forefinger (index finger), as will be discussed more fully below. Approximately symmetrically opposite the upper protuberance 18 on the lower external surface of the shell 14 is an extended foot 20, preferably shaped generally in the form of two low-profile extended fingers 20*a*, 20*b* sized and positioned to support the opener 10 in an upright position when placed on a countertop or other flat, horizontal surface. The foot 20 is blended into the shape of the shell 14 to provide a streamlined appearance and to prevent the user's hand from engaging sharply radiused surfaces. The foot 20 merges into the shell 14 such that a flat 22 is created at the bottom of the shell 14 for standing support of the opener 10 and further to provide a flat region which is particularly well suited for application of identifying text, such as make, model, etc. Advantageously, the foot 20 also provides a counterpart to the upper protuberance 18 such that when the user's hand engages the shell 14, and the outside lateral portion of the user's index finger is engaging the upper protuberance 18, the outside lateral portion of the user's fourth finger (little finger) engages the upper surface of the foot 20, thereby forming and supporting the upper and lower periphery of the user's grip.

Intermediate the upper protuberance 18 and the foot 20 are three equidistantly spaced finger ridges 24 which define interstitial spaces 26 for receiving the user's four fingers. For users with larger hands, the fourth finger may be placed comfortably below the foot 20, leaving only three fingers between the upper protuberance 18 and the foot 20. The shell 14 is also provided with opposing lateral ridges 28 which act as fingertip grips to further provide for secure grip by the hand of the user. Further, the shell 14 preferably includes a slight depression defined by a gently radiused slope 30 which generally circumscribes the region that accepts the palm and four fingers of the user's hand.

Referring now to FIGS. 1, 2, 5 and 6–7, complementary to the shell 14 in creating an enclosed housing 12 is a working face 16 which preferably is, in relation to the shell 14, generally outwardly convex. The working face 16 preferably includes a concentrically central plane 32. The working face 16 mates with the shell 14 along an interface 34 which includes a working face ridge 36 which mates with a complementary concentric rabbet 38 in the shell 14. To provide a secure interconnection between the shell 14 and the working face 16, a trio of screws 40 reside within depressions 42 in the shell 14, secured within receiving holes (not shown) in the interior region of the working face 16. It is also contemplated that the working face 16 may be generally planar without departing from the spirit and scope of the invention.

Preferably, the shell 14 and working face 16 are both formed of a polymeric material. Alternatively, either one or both of the shell 14 and the working face 16 may be formed of any relatively inexpensive, lightweight, rigid and durable material.

Referring now to FIGS. 1 and 3, 5 and 7, positioned on the working face 16, and in particular, on the central plane 32, is a cutting mechanism 44. The cutting mechanism 44 includes a cutter 46 which is preferably a blade of a type well known to those skilled in the art. The cutter 46 includes a piercing tip 48 which pierces the lid A3 and thus begins the severing process. The cutter 46 is positioned on a thumb lever 50 which is pivotably mounted to the working face 16. The thumb lever 50 pivots in a plane parallel to and immediately adjacent to the concentrically central plane 32. To accommodate such planar pivoting, the face of the thumb lever 50 that adjoins the central plane 32 is flat as is the central plane 32. The thumb lever 50 pivots through a range beginning at a point where the cutter 46 is significantly above the point at which the cutter 46 would engage a lid A3 (See FIGS. 1 and 5) (to provide for mounting the opener onto a can A unencumbered by the cutter 46) to a point where the cutter 46 would pierce through a lid A3 (See FIG. 2). As shown in FIG. 2, the thumb lever 50 pivots about a point which is above and to the left of the cutter 46. The thumb lever 50 is intended to be actuated by the thumb of the user. Thus when the user's hand grips the opener 10, the user's fingers wrap around the shell 14 as described above and the user's thumb rests on the thumb lever 50. In this regard, the thumb lever 50 includes a crescent shaped rest 52 which is upwardly cupped to receive the under side of the distal end of the user's thumb. The rest 52 is integral with the thumb lever 50 and extends somewhat beyond the general periphery of the thumb lever 50. Preferably, the thumb lever 50 is formed from a polymeric material, but other tough, relatively inexpensive materials may be used.

The thumb lever 50 further includes a pair of opposed, outwardly extending ears 54 for pivotal mounting of a lid-retention magnet arm 56 and corresponding magnet 58. The magnet arm 56 is pivotably mounted to the thumb lever 50 about an axis defined by a magnet arm pin 60, which extends between and is fixedly engaged by the ears 54. Thus, as will be recognized by those skilled in the art, the magnet arm 56 includes a passage (not shown) which loosely engages the pin 60 such that the magnet arm 56 can pivot about the pin 60. The magnet arm 56 includes a recess 62 (shown in FIG. 7) which receives the magnet 58. The magnet 58 includes a retainer cup 64 into which the magnet 58 is fixed. Preferably the magnet is glued into the retainer cup 64, but may be retained by other methods, such as interference fit between the magnet 58 and the retainer cup 64.

Figure 7:
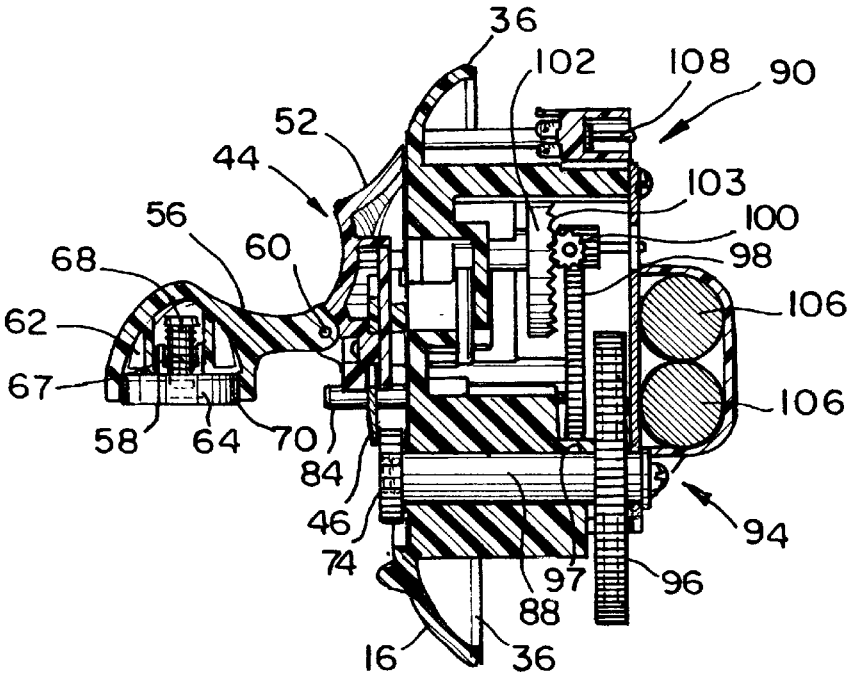
FIG. 7 is a cross-sectional view of the can opener shown in FIG. 6 taken along a line 7—7 of FIG. 6.

Referring to FIG. 7, the retainer cup 64 is attached to a stud 66 having a retention head on its end. A bushing 68 is slidably positioned on the stud 66, the bushing 68 having a centrally disposed passage (not shown) through which an elongated stem of the stud 66 slidably passes but which is sized so as not to pass over the head of the stud 66. A spring 67 is positioned over the stud 66 between the head of the stud 66 and the bushing 68 such that the bushing 68 is biased toward the retainer cup 64. The bushing 68 is sized so that it is fixedly received by a receiver 70, thus retaining the magnet 58 within the magnet arm 56 and permitting the magnet arm 56 to move into and out of the recess 62 a small amount equal to the distance the bushing 68 may slide on the stud 66.

Figure 5:
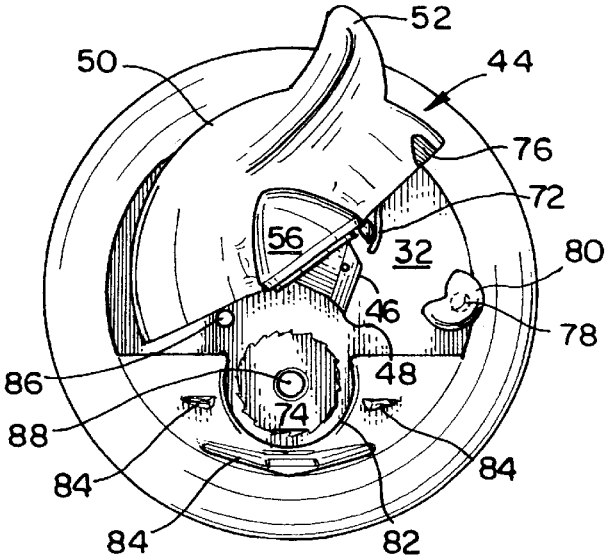
FIG. 5 is a front elevational view of the can opener of FIG. 1 taken from the perspective of line 5—5 in FIG. 3.

Referring now to FIG. 2, depending from a lower portion of the thumb lever 50 is a resilient member 72 well known to those skilled in the art and which is preferably formed from spring steel or other resilient material. The resilient member 72 slides along the top surface of the seam A3 to provide a force which maintains the lower outer portion of the seam in engagement with a drive wheel 74, which is part of a drive mechanism 90 described below. The thumb lever 50 also includes a switch contact region 76 which engages and actuates a contact switch 78 (described below) which is shrouded within a switch cover 80, positioned on the working face 16 of the opener 10. The switch contact region 76 is essentially a flattened surface that squarely engages the contact switch 78. When the thumb lever 50 is in the "disengaged" or up position as shown in FIGS. 1, 3, and 5, the switch contact region 76 is out of engagement with the contact switch 78. When the thumb lever 50 is in the "engaged" or downward position as shown in FIG. 2, the switch contact region 76 enters the switch cover 80 and engages the contact switch 78, thereby activating the opener 10.

Working in conjunction with the resilient member 72 in retaining the opener 10 on a can A and the drive wheel 74 in engagement with the seam A3 is a positioning pin 86, which extends perpendicularly from the central plane 32. The positioning pin 86 is of a type well known to those skilled in the art and, as will be recognized by such individuals, is positioned such that it engages the top surface of the seam A3 of a can A when the opener 10 is mounted on the can A. The positioning pin 86 is preferably formed of steel or other wear resistant, durable, rigid material. It is contemplated that the positioning pin 86 need not be a pin, per se, but may be any physical structure that when properly positioned maintains the seam A3 of a can A in contact with the drive wheel 74.

As best shown in FIGS. 1, 2, and 5, the working face 16 also includes a cutout 82 which is co-planar with the central plane 32 of the working face 16 and is shaped to receive the drive wheel 74. Surrounding the cutout 82 are positioning ribs 84 which guide a can A into engagement with the drive wheel 74 in a manner well known to those skilled in the art. The drive wheel 74 is positioned adjacent to the working face 16 and is rotatable with respect to the working face 16. As shown in FIGS. 1 and 2, the drive wheel 74 is non-rotatingly, fixedly attached to a drive wheel shaft 88. The drive wheel shaft 88 passes through a passage (not shown) in the working face 16, into the interior of the housing 12 where it is operatively connected to the remainder of the drive mechanism 90. The drive wheel 74 is conventional in that it has a serrated outer circumference for securely engaging the seam A3 of a can A. Further, as best shown in FIG. 7, the exposed circular surface of the drive wheel 74 is preferably closely aligned with the inner surface of the cutter 46 such that when the drive wheel 74 engages the outer, under side of a seam A3, the cutter 46 falls immediately inside the seam A3 on the lid A2 of the can A. The drive wheel 74 is preferably formed of steel or other hard, durable metal.

Figure 6:
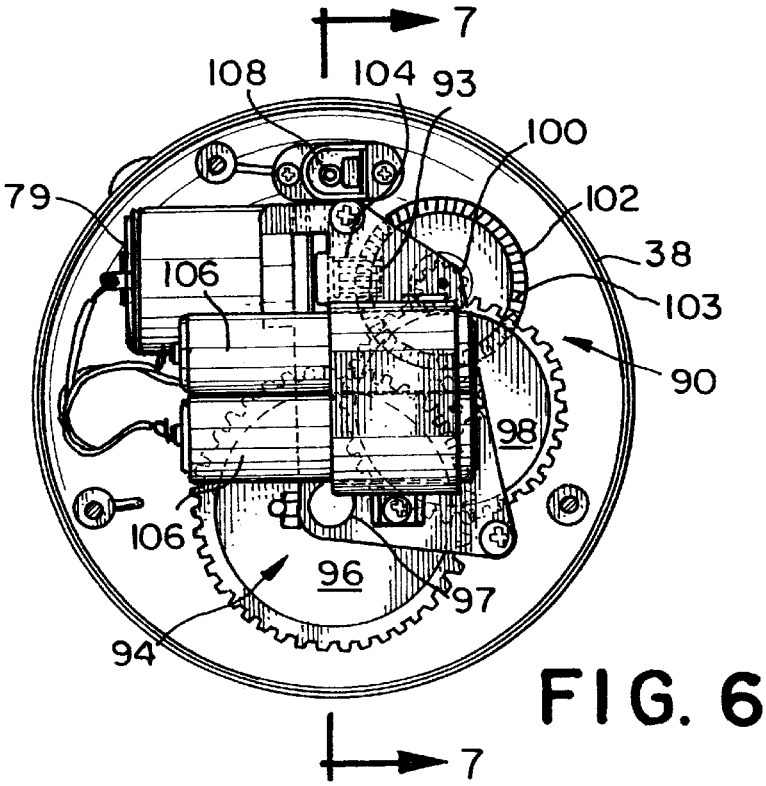
FIG. 6 is a cross-sectional view of the interior of the can opener of FIG. 1, broken apart along line 6—6 of FIG. 3 and viewed from the perspective of line 6—6 of FIG. 3.

Referring now to FIGS. 6 and 7, the remainder of the drive mechanism 90 will be described. The drive mechanism 90 of the preferred embodiment is of a type well known to those skilled in the art. The major components of the drive mechanism 90 include an electric motor 92 and a gear train 94 which is operatively connected to the drive wheel shaft 88 for rotating the drive wheel 74 and thereby rotating a can A. The electric motor 92 is preferably a direct current, high-torque motor of a type well known to those skilled in the art. Regarding the gear train 94, the following description will begin at the drive wheel shaft 88. As stated above, the drive wheel shaft 88 passes into the interior of the housing 12. A first large diameter spur gear 96 is fixedly attached to the inboard end of the drive wheel shaft 88 such that rotation of the first large diameter spur gear 96 rotates the drive wheel 74 with one-to-one correspondence. The first large diameter spur gear 96 is intermeshed with a first small diameter spur gear 97. The first small diameter spur gear 97 is preferably formed integrally and concentrically with a second large diameter spur gear 98, thus the rotation of the first small diameter spur gear rotates the second large diameter spur gear 98 with one-to-one correspondence. The second large diameter spur gear 98 is intermeshed with a second small diameter spur gear 100 which is integral with a large diameter, right angle spur gear 102. The right angle spur gear 102 has teeth 103 facing parallel to its axis of rotation. Each of the spur gears described to this point rotates about an axis of rotation and all the axes of rotation are generally parallel to one another. A motor drive spur gear 104 is fixedly mounted to the output shaft 93 of the electric motor 92 and is intermeshed with the right angle spur gear 102. Thus, the output shaft 93 is generally perpendicular to the axes of rotation of the above-described gears. As those skilled in the art will recognize, the reduction ratio of the gear train 94 is preferably approximately 300:1. Preferably, all gears in the gear train 94 are made from polymeric material, although other inexpensive, lightweight, durable materials may be used without departing from the spirit and scope of the present invention.

Significantly, the use of a right angle spur gear 102 as opposed to a straight spur gear (not shown) provides the advantage of placing the rotating axis, i.e., the output shaft 93, of the electric motor 92 at a right angle to the rotating orientation (axis of rotation) of the first and second large and small diameter spur gears 96, 97, 98, 100, thus permitting the electric motor 92 to be positioned closely adjacent to the inner surface of the working face 16. In so doing, the center of gravity of the opener is advantageously maintained as close as possible to the side A1 of the can A, thereby minimizing the risk that when the opener 10 is supported on the can A, the can A will tip on its side A2. In other words, if the rotational axis of the electric motor 92 were oriented parallel to the rotating axes of the first and second large and small diameter spur gears 96, 97, 98, 100, the weight of the electric motor 92 would necessarily be moved away from the working face 16 and therefore away from the side of the can A, thereby shifting the center of gravity of the opener 10 away from the can A.

The electric motor 92 is preferably powered by a pair of rechargeable batteries 106. Preferably the batteries 106 are nickel cadmium type batteries well known to those skilled in the art. Alternatively, the batteries 106 could be any other type of rechargeable batteries such as nickel metal hydride or lithium ion, etc., and could be non-rechargeable batteries such as alkaline batteries. Preferably the batteries are of the "AA" size. The batteries 106 are connected in series and are operatively connected to, in addition to the electric motor 92, a contact switch 78 which, as discussed above, activates the drive motor 92 in response to activation by the thumb lever 50. It is contemplated that the opener 10 includes circuitry 79 which provides for automatically shutting off the opener 10 once the lid A3 is severed from the can A. Further, in the preferred embodiment, the batteries 106 are operatively connected to a recharger plug 108 of a type well known to those skilled in the art. In a conventional way, once the batteries 106 become discharged, a remote battery charger (not shown) of a type well known to those skilled in the art is electrically connected via a recharger cord 110 (FIGS. 3 and 4) to the recharger plug 108 and to a wall outlet for recharging the batteries 106.

Figure 9:
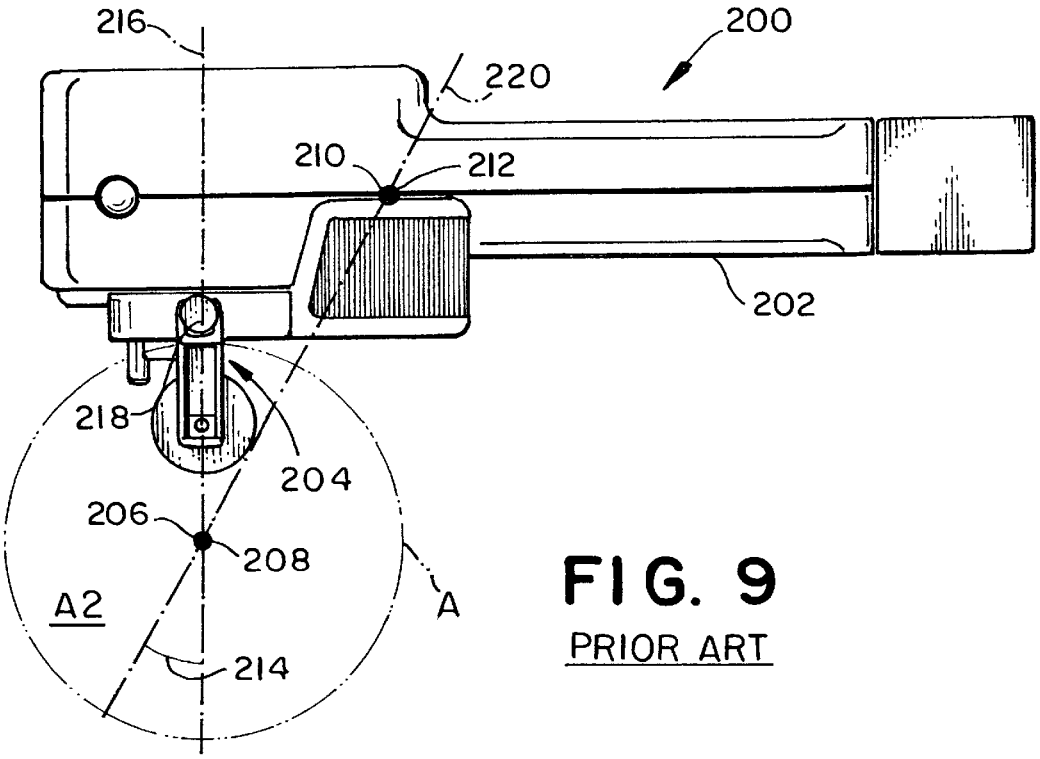
FIG. 9 PRIOR ART
FIG. 9 is a top plan view of a prior art can opener attached to a can.
Figure 10:
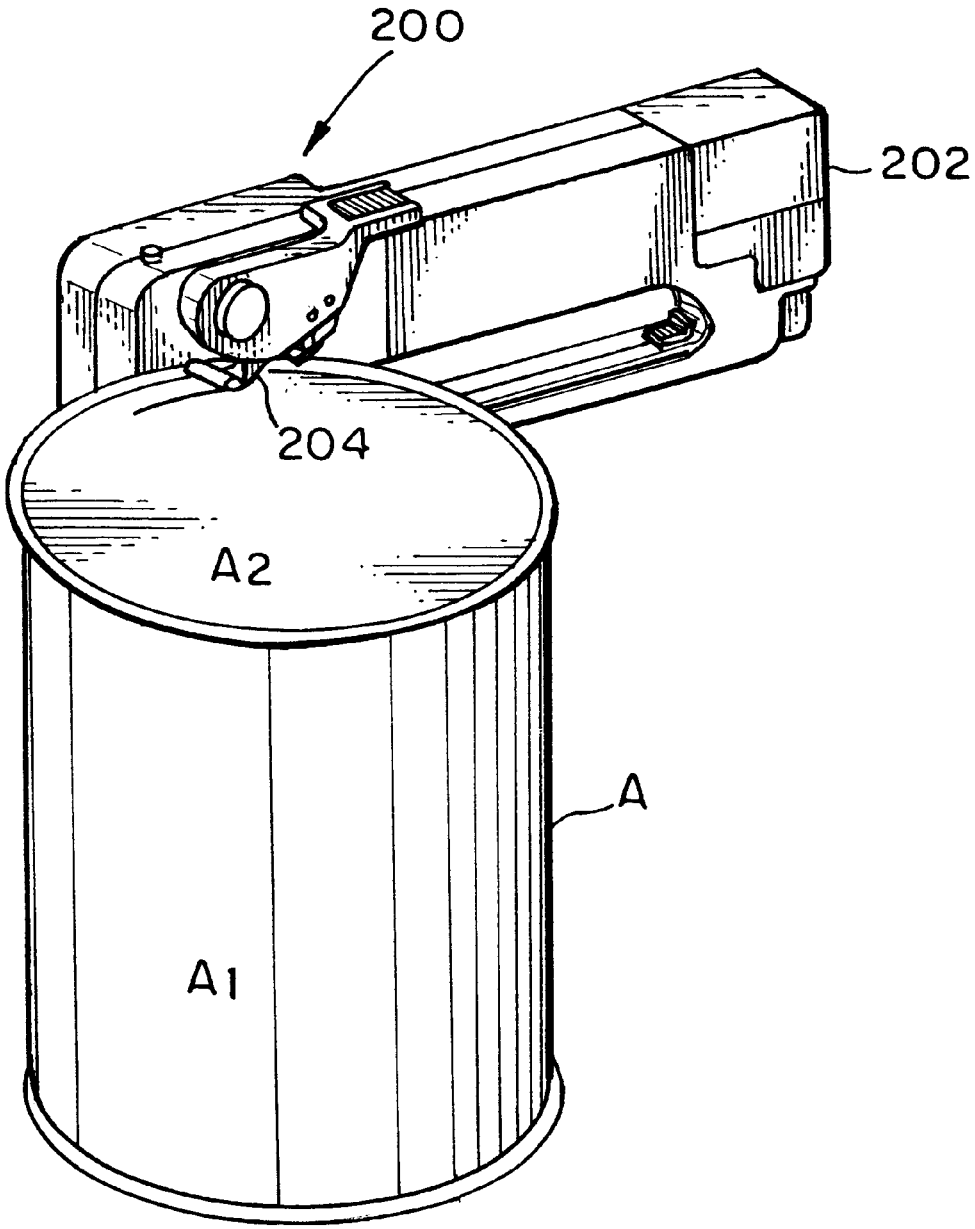
FIG. 10 PRIOR ART
FIG. 10 is a perspective view of the prior art can opener of FIG. 9 attached to a can.

Importantly, the generally semispherical shape of the housing 12 achieves the important goal of moving the center of gravity of the can opener 10 with respect to the center of gravity of prior art can openers. Referring to FIGS. 9 and 10, a prior art can opener 200 is shown with an elongated handle 202. As shown in FIG. 9, the center of gravity of such prior art can openers 200 is, with respect to the center of gravity of the can, angularly offset from the point of contact between the cutter mechanism 204 of the can opener 200 and the can A. Stated differently, still referring still to FIG. 9, the can has a longitudinal axis 206 therethrough passing through its center of gravity 208 and the longitudinal axis of the can A is oriented vertically during severing of the lid A2. The can opener 200 has a vertically oriented axis 210 (i.e., a vertical center of gravity axis 210) passing through its center of gravity 212 when the can opener is positioned on the can A for severing the lid A2. An angle 214 of approximately thirty degrees exists between a first horizontal line 216 passing through the longitudinal axis 206 of the can A and extending through a point of contact 218 between the cutting mechanism 204 and the lid A2, and a second horizontal line 220, coplanar with the first horizontal line 216, passing through the longitudinal axis 206 of the can A and extending through the vertical center of gravity axis 210 of the can opener 200.

Figure 8:
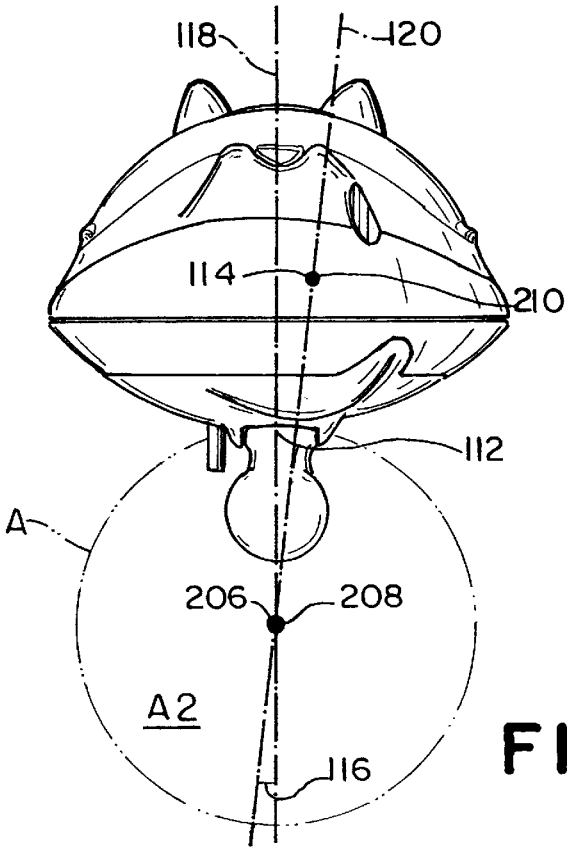
FIG. 8 is a top plan view of the can opener of FIG. 1 shown mounted on a can.

The can opener 10 of the present invention greatly improves on this design, as best shown in FIG. 8, by moving the center of gravity 210 of the opener 10 substantially closer to being aligned with the center of gravity 208 of the can A and the point of contact 112 between the cutting mechanism 44. This can be stated alternatively as follows. Again, the can has a longitudinal axis 206 therethrough passing through its center of gravity 208 and the longitudinal axis of the can A is oriented vertically during severing of the lid A2. The can opener 10 has a vertically oriented axis 114 (i.e., a vertical center of gravity axis 114) passing through its center of gravity 210 when the can opener 10 is positioned on the can A for severing the lid A2. The can opener 10 is configured such that an angle 116 of between about zero degrees and about 20 degrees exists between a first horizontal line 118 passing through the longitudinal axis 206 of the can A and extending through a point of contact 112 between the cutting mechanism 44 and the lid A2, and a second horizontal line 120, coplanar with the first horizontal line 118, passing through the longitudinal axis 206 of the can A and extending through the vertical center of gravity axis 114 of the can opener 10. Again, it should be noted that the can opener is fully supported on the can A during severing. It should also be noted that other housings 12 without elongated handles such as those of the prior art could be used without departing from the scope and spirit of the present invention.

In operation, the user grips the opener 10 as described above with the thumb lever 50 in its "disengaged" position, shown in FIGS. 3 and 5. Referring now to FIGS. 1 and 2, the user then places the opener 10 into engagement with the can A such that the lower, outer portion of the seam A3 engages the drive wheel 74 and the top surface of the seam A3 engages the positioning pin 86. The user then depresses the thumb lever 50 (preferably using the thumb) such that the cutter 46 engages the lid A2. The user continues to depress the thumb lever 50, whereupon the switch contact region 76 of the thumb lever 50 enters the switch cover 80 and engages the contact switch 78, thereby activating the opener 76. The user can then remove his/her hand from the can opener 10. The opener 10 then travels on its own around the circumference of the can A such that the cutter 46 severs the lid A2 from the can A.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

I claim:

1. A can opener for severing a lid from a can, the can opener comprising:

a housing having a shape generally in the form of a semi-sphere, the housing having a semispherical shell and an opposing working face;

a cutting mechanism positioned on the working face for movement along a circumference of the lid to sever the lid from the can, wherein the can supports the entire weight of the can opener during severing; and a drive mechanism positioned on the working face for moving the can opener relative to the can.

2. The can opener of claim 1 wherein the drive mechanism further comprises a can drive wheel positioned on a drive wheel shaft for rotation about a first axis.

3. The can opener of claim 2 wherein the drive mechanism further comprises:

a gear train within the housing and operatively connected to the drive wheel shaft for rotating the can drive wheel; and an electric motor within the housing and operatively connected to the gear train for driving the gear train.

4. The can opener of claim 3 further comprising circuitry for switching off the electric motor when the lid has been severed from the can.

5. The can opener of claim 4 further comprising a rechargeable battery within the housing in electrical communication with the electric motor.

6. The can opener of claim 1, wherein the working face is generally planar.

7. The can opener of claim 1 wherein the housing is handless.

8. The can opener of claim 1 wherein the semispherical housing of the can opener is sized to generally fit within a cupped hand of a user.

9. The can opener of claim 8 wherein the cutting mechanism is moveable by a user's thumb while the semispherical housing is positioned within the cupped hand of the user.

10. A can opener for severing a lid from a can, the can opener comprising:

a housing without an extended handle;

a cutting mechanism for movement along a circumference of the lid and thereby severing the lid from the can; and a drive mechanism for moving the can opener and the cutting mechanism relative to the can while the can remains stationary wherein the housing, the cutting mechanism and the drive mechanism are sized and positioned such that the can opener is fully supported by the can during severing.

11. The can opener of claim 10 wherein the housing is generally in the shape of a semi-sphere.

12. The can opener of claim 11 wherein the drive mechanism further comprises a can drive wheel positioned on a drive wheel shaft for rotation about a first axis.

13. The can opener of claim 12 wherein the drive mechanism further comprises:

a gear train within the housing and operatively connected to the drive wheel shaft for rotating the can drive wheel; and an electric motor within the housing and operatively connected to the gear train for driving the gear train.

14. The can opener of claim 13 further comprising circuitry for switching off the electric motor when the lid has been severed from the can.

15. The can opener of claim 14 further comprising a rechargeable battery within the housing.

16. A can opener for severing a lid from a can, the can having a longitudinal axis therethrough passing generally through the center of gravity of the can, the longitudinal axis of the can being oriented generally vertically during severing, a generally vertical axis passing through center of gravity of the can opener when the can opener is positioned on the can for severing the lid, the can opener comprising:

a housing;

a cutting mechanism positioned on the housing for movement along a circumference of the lid and thereby severing the lid from the can; and a drive mechanism positioned within the housing for moving the can opener and the cutting mechanism relative to the can;

the can opener being fully supported on the can during severing and configured such that an angle of less than about twenty degrees exists between (a) a first generally horizontal line passing through the longitudinal axis of the can and extending through a point of contact between the cutting mechanism and the lid, and (b) a second generally horizontal line, coplanar with the first horizontal line, passing through the longitudinal axis of the can and extending through the vertical axis passing through the center of gravity of the can opener.

17. The can opener of claim 16 wherein the housing is generally in the shape of a semi-sphere.

18. The can opener of claim 17 wherein the drive mechanism further comprises a can drive wheel positioned on a drive wheel shaft for rotation about a first axis.

19. The can opener of claim 18 wherein the drive mechanism further comprises:

a gear train within the housing and operatively connected to the drive wheel shaft for rotating the can drive wheel; and an electric motor within the housing and operatively connected to the gear train for driving the gear train.

20. The can opener of claim 19 further comprising circuitry for switching off the electric motor when the lid has been severed from the can.

21. The can opener of claim 20 further comprising a rechargeable battery within the housing.

22. A can opener for severing a lid from a can, the can opener comprising:

a housing having a gripping shell and an opposing working face, the gripping shell being arcuately shaped to complementarily fit within a cupped hand of a user;

a cutting mechanism positioned on the working face for movement along a circumference of the lid to sever the lid from the can, wherein the can supports the entire weight of the can opener during severing, the cutting mechanism is movable between an open position for receiving the can and a cutting position wherein the can is being severed, the cutting mechanism including a lever positioned proximate the working face for moving the cutting mechanism between the open and cutting positions, the lever being actuable by a thumb of a user from the open to the cutting position when the gripping shell is positioned within the cupped hand of a user; and a drive mechanism positioned on the working face for moving the can opener relative to the can.

23. A can opener for severing a lid from a can, the can opener comprising:

a housing having a shape wherein the center of gravity of the can opener, a cutting point on the can and the center of gravity of the can are generally aligned with each other, such that the can supports the entire weight of the can opener during severing, and wherein the housing is sized to generally complementarily fit within a cupped hand of a user;

a cutting mechanism positioned on the housing for movement along a circumference of the lid to sever the lid from the can, wherein the cutting mechanism is movable between an open position for receiving the can and a cutting position wherein the can is being severed, the cutting mechanism including a lever positioned proximate a working face for moving the cutting mechanism between the open and cutting positions, the lever being actuable by a thumb of a user from the open to the cutting position when the housing is positioned within the cupped hand of the user; and a drive mechanism positioned on the housing for moving the can opener relative to the can.

* * * * *